US006038530A

United States Patent [19]

Taori et al.

[11] Patent Number: 6,038,530

[45] Date of Patent: Mar. 14, 2000

[54] COMMUNICATION NETWORK FOR TRANSMITTING SPEECH SIGNALS

[75] Inventors: Rakesh Taori; Andreas J. Gerrits, both of Eindhoven, Netherlands

[73] Assignee: U.S. Philips Corporation, New York, N.Y.

[21] Appl. No.: 09/020,606

[22] Filed: Feb. 9, 1998

[30] Foreign Application Priority Data

Feb. 10, 1997 [EP] European Pat. Off. ..... 97200358

[51] Int. Cl.[7] ..... G10L 9/14

[52] U.S. Cl. ..... 704/219; 704/223; 704/234; 704/220; 704/249

[58] Field of Search ..... 704/223, 219, 704/234, 220, 249

[56] References Cited

U.S. PATENT DOCUMENTS

| | | | |
|---|---|---|---|
| 4,544,919 | 10/1985 | Gerson | 340/347 |
| 5,093,863 | 3/1992 | Galand et al. | 381/38 |
| 5,251,261 | 10/1993 | Meyer et al. | 704/270 |
| 5,353,373 | 10/1994 | Drogo De Iacovo et al. | 704/223 |
| 5,617,507 | 4/1997 | Lee et al. | 704/200 |
| 5,664,055 | 9/1997 | Kroon | 704/223 |
| 5,732,389 | 3/1998 | Kroon et al. | 704/223 |
| 5,822,732 | 10/1998 | Tasaki | 704/268 |

OTHER PUBLICATIONS

"Real–Time Communication on the Net", in PC Magazine, Oct. 8, 1996, pp. 102–120.

*Primary Examiner*—David R. Hudspeth
*Assistant Examiner*—Vijay B Chawan
*Attorney, Agent, or Firm*—Jack D. Slobod

[57] ABSTRACT

In a speech communication network in which a transmitter (1) transmits speech signals via a network (4) to a receiver (8), it can happen that more traffic is offered to the network (4) than it can handle. In order to reduce the network load, at least one node (24) is arranged to perform bitrate reduction to delete some of the prediction parameters representing the speech signal. It can also be the case that a receiver comprises a speech decoder having insufficient computational power available for decoding the encoded speech signal. In such case, the speech decoder is arranged for using only a part of the prediction parameters available. This results in a lower complexity of the synthesis filter (60).

14 Claims, 3 Drawing Sheets

COMMUNICATION NETWORK FOR TRANSMITTING SPEECH SIGNALS

BACKGROUND OF THE INVENTION

1. Field of the Invention

The present invention is related to a communication network including at least one transmitter having a speech encoder for deriving from an input signal a plurality of prediction coefficients of a prediction filter and an excitation signal, and a multiplexer for deriving a symbol sequence including a representation of the plurality of prediction coefficients and a representation of the excitation signal, the communication network being arranged for transmitting the symbol sequence to a receiver with a speech decoder. The present invention is also related to a receiver, a decoder and a transmission method.

2. Description of the Related Art

A communication network according to the preamble is known from the article "Real Time Communication on the Net" in PC Magazine, Oct. 8, 1996, pp. 102–120.

With the rapidly growing number of users of the Internet and the advanced developments in speech coding, Internet based telephony may become a real alternative for the common PSTN network. This is in particular true for international calls, due to the substantial savings that can be obtained. A communication system according to the preamble uses a speech coder in order to reduce the required bitrate from the standard 64 kb/s to a substantially lower rate ranging from 2–16 kb/s.

Most speech encoders derive parameters for a synthesis filter in the speech decoder together with a suitable excitation signal to be applied to the synthesis filter. The determination of the filter parameters is based on so called prediction parameters which define the short time spectrum of the input speech signal. The excitation signal can be found in different ways. One way, the analysis by synthesis method, involves synthesizing a speech signal using a predetermined number of excitation signals, and selecting the excitation signal which results in a synthetic speech signal which gives the best match with the input speech signal. Another way to find the excitation signal is to filter the input speech signal with an inverse synthesis filter, and encode the residual signal at the output of said filter.

A problem with the communication system according to the preamble is that it is possible that more speech traffic is offered to the network than it can handle. This can lead to loss of a connection or to a large delay of the speech signal to be transmitted. It is also possible that a speech signal is encoded according to a format which is too complex to decode with the decoder available at the receiver.

OBJECT AND SUMMARY OF THE INVENTION

The object of the present invention is to provide a communication network in which at least one of the above mentioned problems is alleviated.

Therefore the communication network is characterized in that the communication network comprises means for deleting a part of the symbol sequence representing some of the prediction parameters, and in that the decoder is arranged for reconstructing a speech signal from the remaining part of the symbol sequence.

If the network outside the receiver is arranged to delete a part of the symbol sequence representing the prediction parameters, the load of the network can be substantially reduced. If the receiver is arranged to delete a part of the symbol sequence representing the prediction parameters, the complexity of the synthesis filter, and therewith the complexity of the receiver, can be reduced to an amount that the decoder is able to decode the remaining part of the symbol sequence. By deleting a portion of the symbol sequence representing some of the prediction parameters, the speech signal can still be reproduced using a synthesis filter which uses only the prediction parameters which are available, at the cost of a slightly degraded speech quality.

An embodiment of the invention is characterized in that said representation of prediction parameters is based on reflection coefficients.

The use of a representation based on reflection coefficients has the advantage that even a reduced number of received reflection coefficients can directly be used to control the synthesis filter. With some other representations of the prediction parameters, such as a-parameters or Line Spectral Frequencies a synthesis based on a reduced number of received coefficients could lead to a substantially reduced speech quality.

A further embodiment of the invention is characterized in that said representation comprises logarithmic area ratios.

Using logarithmic area ratios has the advantage that they have the same properties as reflection coefficients with respect to the suitability to derive easily the parameters for the synthesis filter. Logarithmic area ratios have also the property that quantization does not cause large synthesis errors if the parameters of the synthesis filter are derived from quantized log area ratios.

BRIEF DESCRIPTION OF THE DRAWING

The present invention will now be explained with reference to the drawing which shows in FIG. 1, a communication network according to the invention, in which bitrate reduction takes place within the network.

DETAILED DESCRIPTION OF THE PREFERRED EMBODIMENTS

Figure 1:
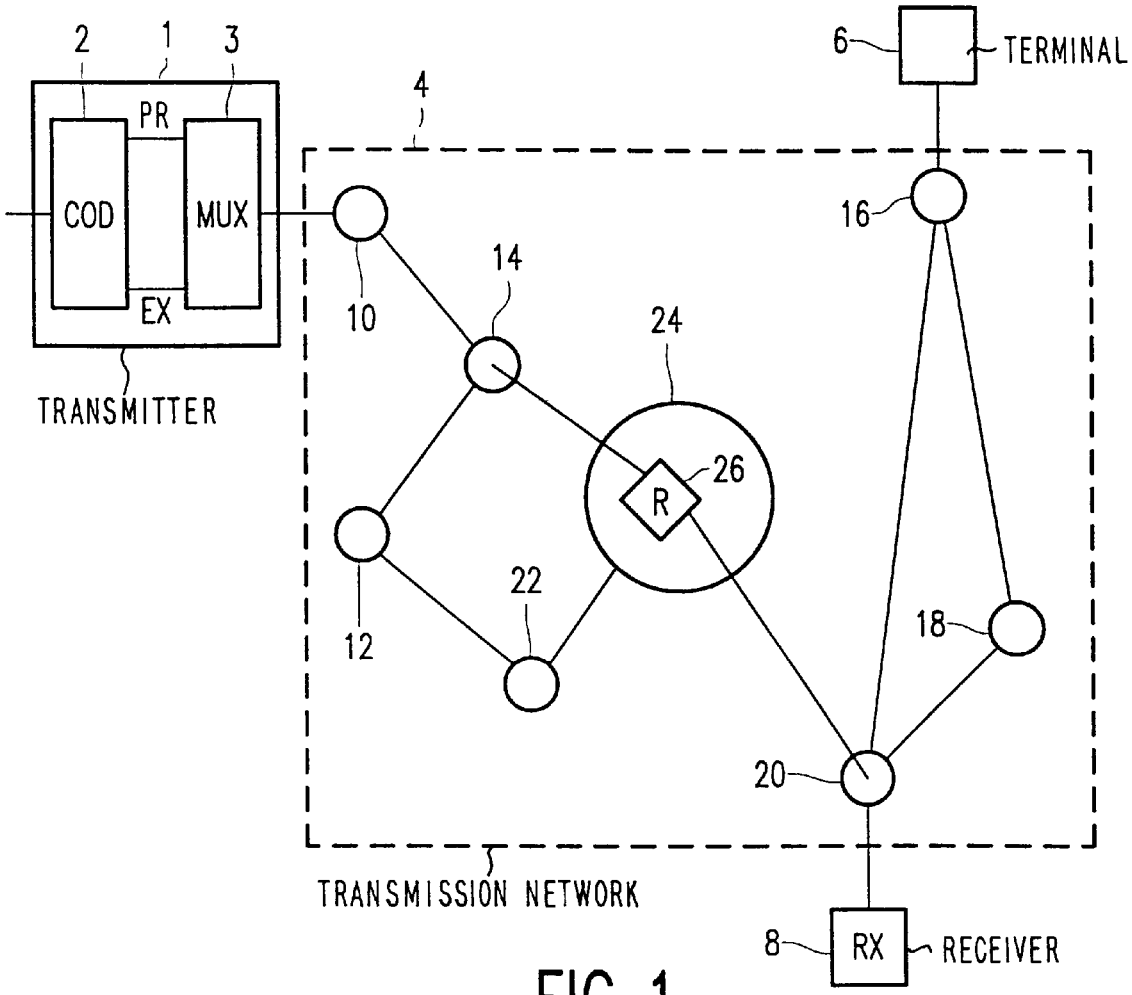

In the communication network according to FIG. 1, a transmitter 1 and a receiver 8 are connected to a transmission network 4. The input of the transmitter 1 is connected to an input of a speech coder 2. A first output of the speech coder 2, carrying a signal PR representing the prediction coefficients, is connected to a first input of a multiplexer 3. A second output of the speech coder 2, carrying a signal EX representing the excitation signal, is connected to a second input of the multiplexer 3. The output of the multiplexer 3 is coupled to the output of the transmitter 1.

The output of the transmitter 1 is connected to a node 10 in a transmission network 4. The node 10 is connected to nodes 12 and 14. The node 14 is also coupled to a node 24. The node 24 comprises means for deleting a part of the symbol sequence further to be referred to as bitrate reducing means 26. The node 24 is connected to a node 16, a node 20 and a node 22. The node 22 is also connected to node 12. A terminal 6 is connected to node 16, which node is also connected to node 20 and node 18. Node 18 is connected to node 20. A receiver 8 is connected to the node 20 in the transmission network 4.

In the explanation of the communication network according to FIG. 1, it is assumed that the speech encoder 2 is arranged for encoding frames comprising a plurality of 30 samples of the input speech signal. In the speech coder once per frame a number of prediction coefficients representing the short term spectrum of the speech signal is calculated from the speech signal. The prediction coefficients can have various representations. The most basic representations are so-called a-parameters. The a-parameters a[i] are determined by minimizing an error signal. Different types of error signals to be minimized are known. An example is given by:

$$E = \sum_{n=1}^{N} \left( s(n) - \sum_{i=1}^{P} a[i] \cdot s(n-i) \right)^2 \tag{1}$$

In (1) s(n) represents the speech samples, N represents the number of samples in a speech frame, P represents the prediction order, and i and n are running parameters. Normally a-parameters are not transmitted because they are very sensitive to quantization errors. An improvement of this aspect can be obtained by using so-called reflection coefficients or derivatives thereof such as log area ratios and the inverse sine transform. The reflection coefficients r[i] can be determined from the a-parameters according to the following recursion:

$$\left.\begin{aligned} \alpha[i] &= a[i] \\ r[i] &= \alpha^{(i)}[i] \\ \alpha^{(i-1)}[m] &= \frac{\alpha^{(i)}[m] + \alpha^{(i)}[i] \cdot \alpha^{(i-1)}[i-m]}{l - r[i]^2};\ m = 1, \ldots, i-1 \end{aligned}\right\} i = P, P-1, \ldots 2, 1 \tag{2}$$

The log-area ratios and the inverse sine transform are respectively defined as:

$$LAR[i] = 1n\left(\frac{1 - r[i]}{1 + r[i]}\right) \tag{3}$$

and $$g_k = \sin^{-1}(r[i]) \tag{4}$$

Another suitable representation of the prediction parameters are so-called Line Spectrum Pairs or Line Spectrum Frequencies. The above mentioned representations of prediction coefficients are well known to those skilled in the art. The representation PR of the prediction coefficients is available at the first output of the speech coder.

Besides the representation of the prediction coefficients, the speech coder provides a signal EX representation of the excitation signal. For the explanation of the present invention it will be assumed that the excitation signal is represented by codebook indices and associated codebook gains of a fixed and an adaptive codebook, but it is observed that the scope of the present invention is not restricted to such type of excitation signals. Consequently the excitation signal is formed by a sum of codebook entries weighted with their respective gain factors. These codebook entries and gain factors are found by an analysis by synthesis method.

The representation of the prediction signal and the representation of the excitation signal is multiplexed by the multiplexer 3 and subsequently transmitted to the transmission network 4. The transmission network 4 can be a packet switched network such as an ATM network or the Internet based on the TCP/IP protocol. The speech signal can travel the network 4 via different paths to the receiver 8.

The nodes of the network 4 are provided with bitrate reducing means 26 being able to delete the representation of some of the prediction parameters of speech signals to be transmitted in the case of heavy traffic conditions of the network. The reduction of the network load will prevent a severe loss of quality of the transmitted speech signal under such heavy traffic conditions.

Figure 2:
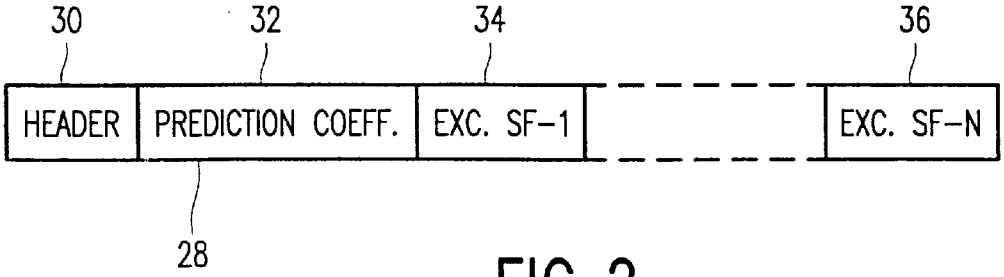
FIG. 2, the constitution of a frame comprising a sequence of symbols representing the speech signal.
Figure 3:
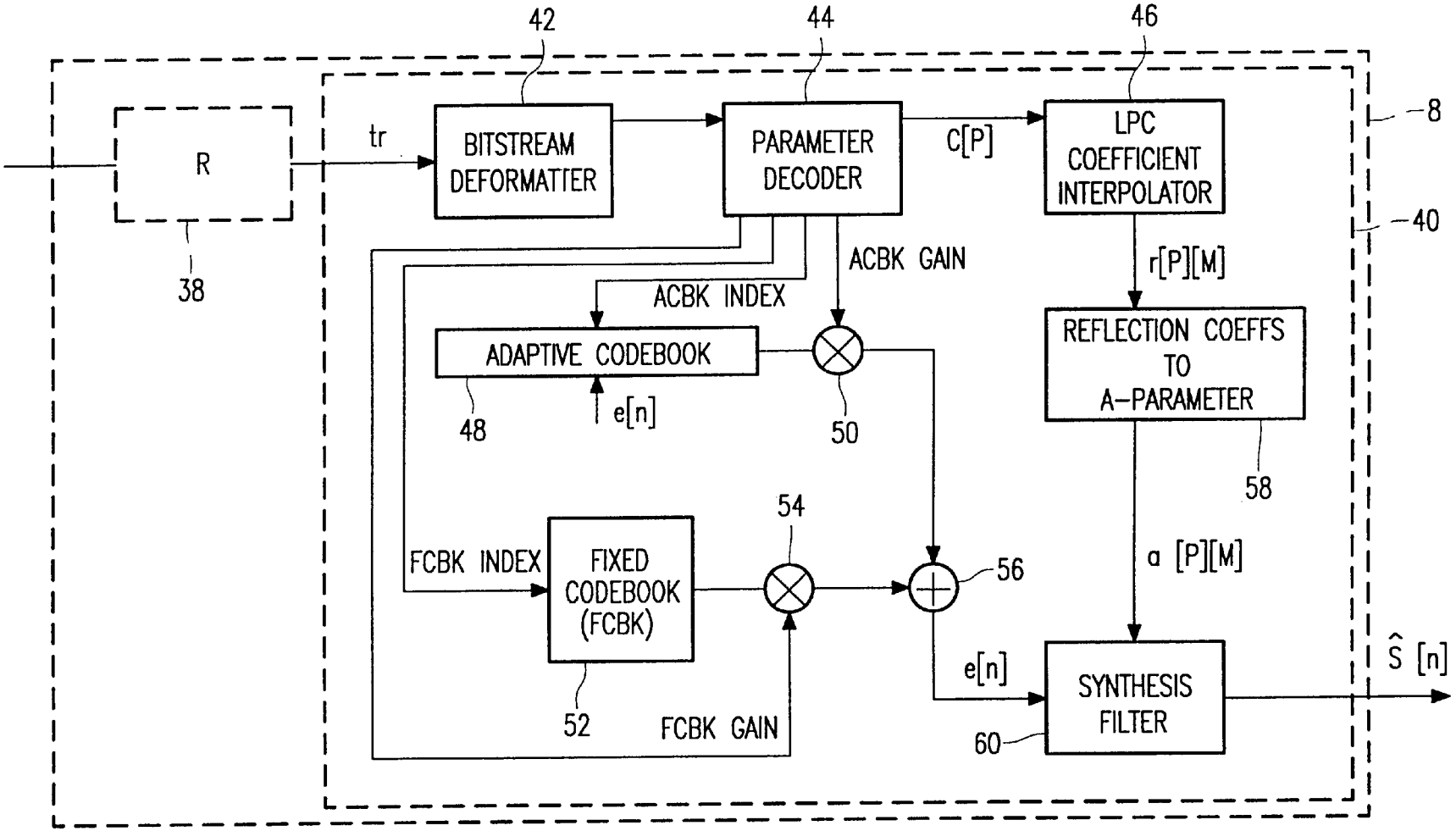
FIG. 3, a block diagram of a receiver to be used in a network according to the invention.

The frame 28 according to FIG. 2 comprises a header 30 for transmitting necessary properties of said frame. It comprises the actual number of prediction coefficients transmitted in the portion 32 reserved for the representation of the prediction coefficients. Alternatively, it can also state the number of bits used for each prediction coefficient. The portions 34 . . . 36 in the frame represent the excitation signal. Because in a CELP coder the frame of signal samples may be subdivided in M sub-frames each with its own excitation signal, M portions are present in the frame to represent the excitation signal for the complete frame.

In the receiver 8, the input signal is applied to an input of a decoder 40, optionally via a bitrate reducer 38. In the decoder 40, outputs of a bitstream deformatter 42 are connected to corresponding inputs of a parameter decoder 44. A first output of the parameter decoder 44, carrying an output signal C[P] representing P prediction parameters is connected to an input of an LPC coefficient interpolator 46. A second output of the parameter decoder 44, carrying a signal FCBK INDEX representing the fixed codebook index, is connected to an input of a fixed codebook 52. A third output of the parameter decoder 44, carrying a signal FCBK GAIN representing the fixed codebook gain, is connected to a first input of a multiplier 54. A fourth output of the parameter decoder 44, carrying a signal ACBK INDEX representing the adaptive codebook index, is connected to an input of an adaptive codebook 48. A fifth output of the parameter decoder 44, carrying a signal ACBK GAIN representing the adaptive codebook gain, is connected to a first input of a multiplier 54.

An output of the adaptive codebook 48 is connected to a second input of the multiplier 50, and an output of the fixed codebook 52 is connected to a second input of the multiplier 54. An output of the multiplier 50 is connected to a first input of an adder 56, and an output of the multiplier 54 is connected to a second input of the adder 56. An output of the adder 56, carrying signal e[n], is connected to a first input of a synthesis filter 60, and to an input of the adaptive codebook 48.

An output of the LPC coefficient interpolator 46, carrying a signal r[P][M] representing the reflection coefficients, is connected to an input of a converter 58. An output of the converter 58, carrying a signal a[P][M] representing the a-parameters, is connected to a second input of the synthesis filter 60. At the output of the synthesis filter 60 the reconstructed speech signal ŝ[n] is available.

In the receiver 8 the bitstream at the input of the decoder 40 is disassembled by the deformatter 42. Dependent on the information found in the header, the prediction coefficients are extracted from the bitstream and passed to the LPC coefficient interpolator 46. It is also possible that the receiver extracts less LPC coefficients than are available in the bitstream in order to reduce its complexity.

The determination of the prediction parameters is based on a look-up table which returns the value of a reflection coefficient in response to an index C[i] representing the $i^{th}$ reflection coefficient. In order to be able to look up the reflection coefficients in a single table, a sub table is used to define a value Offset for each of the values of i. It is assumed that a maximum of 20 prediction parameters is present in the input frames.

TABLE 1

| i | Offset | i | Offset |
|---|---|---|---|
| 0 | 13 | 10 | 18 |
| 1 | 0 | 11 | 17 |
| 2 | 16 | 12 | 19 |
| 3 | 12 | 13 | 17 |
| 4 | 16 | 14 | 19 |
| 5 | 13 | 15 | 18 |
| 6 | 16 | 16 | 19 |
| 7 | 14 | 17 | 17 |
| 8 | 18 | 18 | 19 |
| 9 | 16 | 19 | 18 |

For each of the prediction parameter, the offset in the main table (Table 2) is determined from table 1, by using the rank number i of the prediction coefficient as input. Subsequently the entry in table 2 is found by adding the offset value Offset to the level number C[i]. Using said entry, the value of the corresponding reflection coefficient r[k] is read from Table 2.

TABLE 2

| C[i] + Offset | r[i] | C[i] + Offset | r[i] |
|---|---|---|---|
| 0 | −0.9896 | 25 | 0.4621 |
| 1 | −0.9866 | 26 | 0.5546 |
| 2 | −0.9828 | 27 | 0.6351 |
| 3 | −0.9780 | 28 | 0.7039 |
| 4 | −0.9719 | 29 | 0.7616 |
| 5 | −0.9640 | 30 | 0.8093 |
| 6 | −0.9540 | 31 | 0.8483 |
| 7 | −0.9414 | 32 | 0.8798 |
| 8 | −0.9253 | 33 | 0.9051 |
| 9 | −0.9051 | 34 | 0.9253 |
| 10 | −0.8798 | 35 | 0.9414 |
| 11 | −0.8483 | 36 | 0.9540 |
| 12 | −0.8093 | 37 | 0.9640 |
| 13 | −0.7616 | 38 | 0.9719 |
| 14 | −0.7039 | 39 | 0.9780 |
| 15 | −0.6351 | 40 | 0.9828 |
| 16 | 0.5546 | 41 | 0.9866 |
| 17 | −0.4621 | 42 | 0.9896 |
| 18 | 0.3584 | 43 | 0.9919 |
| 19 | −0.2449 | 44 | 0.9937 |
| 20 | −0.1244 | 45 | 0.9951 |

TABLE 2-continued

| C[i] + Offset | r[i] | C[i] + Offset | r[i] |
|---|---|---|---|
| 21 | 0 | 46 | 0.9961 |
| 22 | 0.1244 | 47 | 0.9970 |
| 23 | 0.2449 | 48 | 0.9977 |
| 24 | 0.3584 | | |

The set of reflection coefficients determined from Table 2 describes the short term spectrum for the $M^{th}$ subframe of each frame. The prediction parameters for the preceding subframes of a frame are found by interpolation between the prediction parameters for the current frame and the prediction coefficients for the previous frames. However the interpolation is not based on the reflection coefficients, but on the log area ratios calculated from the reflection coefficients. For the log area ratios can be written:

$$l_k[i] = 1n\left(\frac{1 - r_k[i]}{1 + r_k[i]}\right) \tag{5}$$

For subframe m of frame k, the interpolated value of the log area ratios are given by:

$$\hat{l}_k[i][m] = \frac{M - m}{M} l_{k-1}[i] + \frac{m}{M} l_k[i] \;\; ; 0 \le i \le P - 1; \;\; 1 \le m \le M - 1 \tag{6}$$

From each interpolated log area ratio an interpolated reflection coefficient is calculated according to:

$$\hat{r}_k[i][m] = \frac{1 - e^{\hat{l}_k[i][m]}}{1 + e^{\hat{l}_k[i][m]}}; \;\; 0 \le i \le P - 1; \;\; 1 \le m \le M - 1 \tag{7}$$

For m=M, $\hat{r}_k[i][m]$ needs not to be computed as it is directly available from Table 2. The a-parameters can be derived from the reflection coefficients according to the following recursion:

$$\left.\begin{aligned} a^{(i)}[i] &= r[i] \\ a^{(i)}[m] &= a^{(i-1)}[m] + r[i] \cdot a^{(i-1)}[i - m]; \; m = 1, \ldots, i - 1 \end{aligned}\right\} i = 1, 2 \ldots P \tag{8}$$

The a-parameters obtained by (8) are supplied to the synthesis filter 60. The synthesis filter 60 calculated the output signal $\hat{S}[n]$ according to:

$$\hat{s}[n] = e[n] + \sum_{i=0}^{P-1} a[i] \cdot \hat{s}[n - i] \tag{9}$$

In (9) e[n] is the excitation signal.

In case the number of prediction coefficients passed to the parameter decoder is less than P due to the bitrate reduction according to the invention, the value of P is substituted by a value of P' smaller than P. The calculations according to (5)–(9) are performed for P' parameters instead of P parameters. The a-parameters for use in the synthesis filter with rank larger than P' are set to 0.

The parameter decoder 44 extracts also the excitation parameters ACBK INDEX, ACBK GAIN, FCKB INDEX and FCBK GAIN for each of the subframes from the bitstream, and presents them to the respective elements of the decoder. The fixed codebook 52 presents a sequence of excitation samples for each subframe in response to the fixed codebook index (FCBK INDEX) received from the parameter decoder 44. These excitation samples are scaled by the multiplier 54 with a gain factor determined by the fixed codebook gain (FCBK GAIN) received from the parameter decoder 44. The adaptive codebook 48 presents a sequence of excitation samples for each subframe in response to the adaptive codebook index (ACBK INDEX) received from the parameter decoder 44. These excitation samples are scaled by the multiplier 50 with a gain factor determined by the adaptive codebook gain (ACBK GAIN) received from the parameter decoder 44. The output samples of the multipliers 50 and 54 are added to obtain the final excitation signal e[n] which is supplied to the synthesis filter. The excitation signal samples for each sub-frame are also shifted into the adaptive codebook, in order to provide the adaptation of said codebook.

Figure 4:
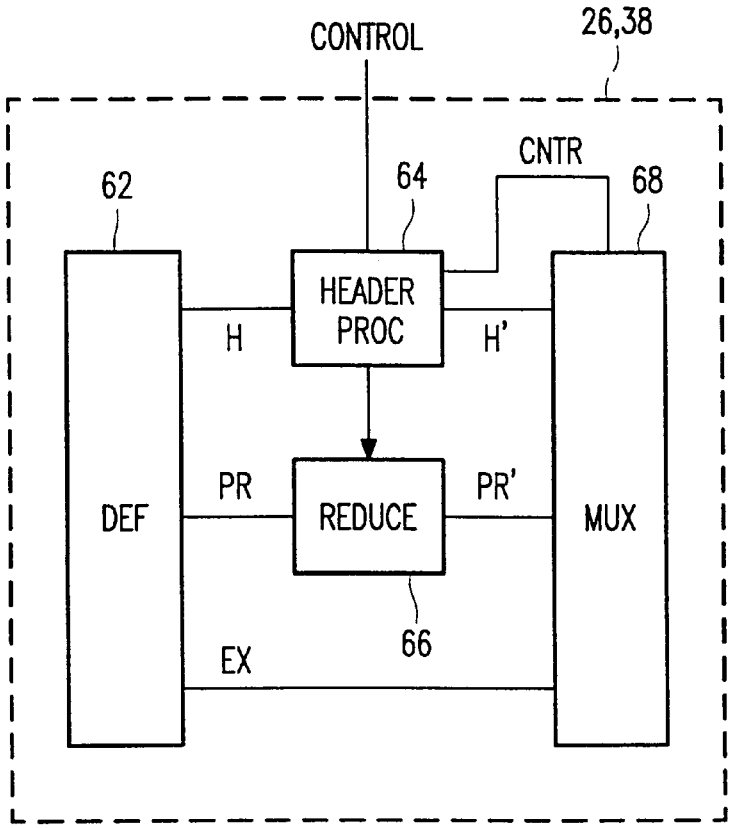
FIG. 4, a block diagram of the bitrate reduction means to be used in the network according to FIG. 1.

In the bitrate reduction means 26,38 according to FIG. 4, the input signal is applied to a deformatter 62. A first output of the deformatter, carrying a signal H representing the header of the frame according to FIG. 2, is connected to an input of a header processor 64. A control signal CONTROL indicating the number of prediction coefficients to be passed by the bitrate reduction means is connected to a control input of the header processor 64. A first output of the header processor 64, carrying control information CNTR for the multiplexer 68 is connected to a control input of said multiplexer 68. A second output of the header processor 64 is connected to a reduction unit 66. A second output of the header processor 64, carrying a signal H' representing a modified header to a first signal input of the multiplexer 68.

A second output of the deformatter 62, carrying an output signal PR representing the prediction parameters determined by the encoder is connected to a signal input of the reduction means 66. An output of the reduction means 66, carrying a signal PR' representing a reduced number of prediction coefficients, is connected to a second signal input of the multiplexer 68.

A third output of the deformatter, carrying a signal representing the excitation signal, is connected to a third input of the multiplexer 68. At the output of the demultiplexer the reduced bitrate signal is available.

In the deformatter 62 the input signal according to the frame depicted in FIG. 2 is decomposed in three parts being the header H, the prediction coefficients PR and the excitation signal EX. The content of the header is read in order to establish the number of prediction coefficients represented by the signal PR. In response to the control signal, the header processor determines the number of prediction coefficient that may be passed to the input of the multiplexer 68. This amount is also communicated to the reduction means 66. In response to this information, the reduction unit 66 passes only the allowed amount of prediction parameters to the multiplexer 68, and the remaining prediction parameters are blocked.

The header processor provides a CNTR signal to the multiplexer 68, in order to inform it about the multiplexing cycle to be applied to the respective input signal, resulting in a correct remultiplexing of the header, the prediction coefficients and the excitation signal.

In the combination of bitrate reduction means 38 and bitstream deformatter 42, the input signal is applied to an input of a deformatter 70. A first output of the deformatter 70, carrying an output signal representing the header, is connected to a first input of a header processor 72. A control signal is applied to a control input of the header processor 72. A second output of the deformatter 70, carrying a signal PR representing the prediction parameters, is connected to an input of reduction means 74. The output of the reduction means 74 is connected to the output of the combination of 38 and 42. An output of the header processor 72 is connected to a control input of the reduction means 74. A third output carrying a signal representing the excitation signal is connected to the output of the combination 38+74.

Figure 5:
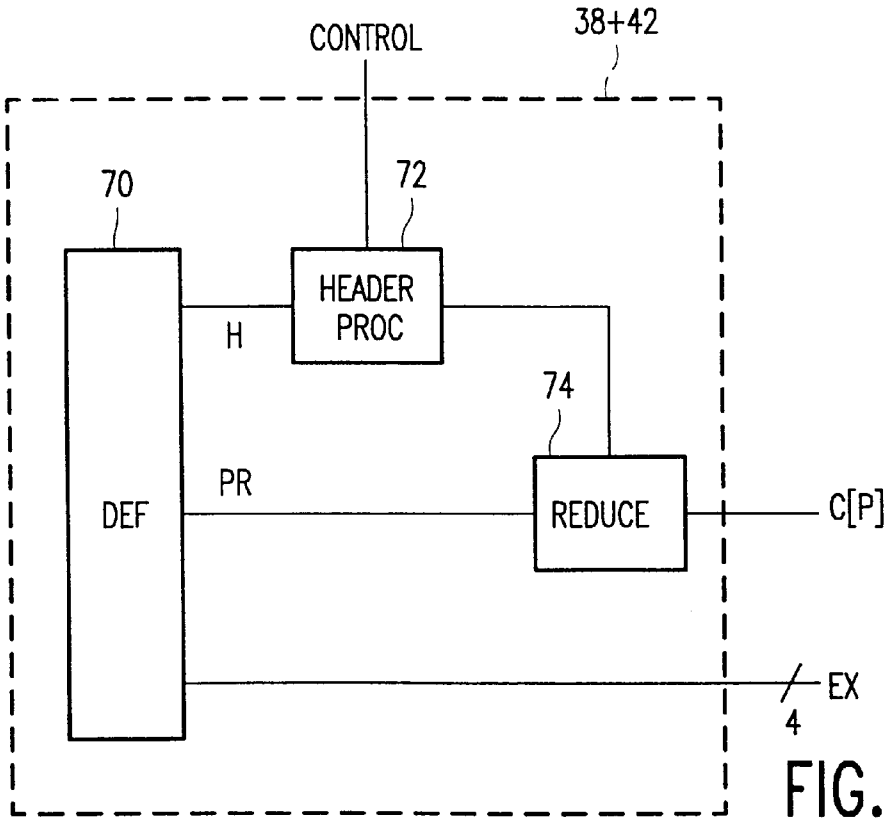
FIG. 5, an alternative implementation of the combination of bitrate reducing means 38 and bitstream deformatter 42 to be used in the receiver according to FIG. 3.

The operation of the combination of 38+42 according to FIG. 5, is similar to that of the bit rate reducing means according to FIG. 4. Because the parameter decoder 44 requires the different parameters such as prediction coefficients and excitation signals to be presented separately, no remultiplexing of said signals is necessary. Also the construction of a new header can be dispensed with. Consequently the complexity of the combination 38+42 is substantially reduced with respect to a separate realization of the bitrate reducing means 38 and the bitstream deformatter 42.

We claim:

1. A communication network comprising:

at least one transmitter which comprises a speech encoder with means for deriving from an input signal a plurality of prediction coefficients of a prediction filter and an excitation signal, and a multiplexer for deriving a symbol sequence including a representation of said plurality of prediction coefficients and a representation of said excitation signal; and a receiver for receiving symbols of the symbol sequence via the communication network, the receiver comprising a speech decoder;

wherein the communication network comprises means for deleting a part of the symbol sequence representing some of the prediction parameters, and the decoder is arranged for reconstructing a speech signal from a remaining part of the symbol sequence.

2. The communication network according to claim 1, wherein the speech decoder comprises a synthesis filter, and the speech decoder is arranged for deriving a reduced set of filter coefficients for the synthesis filter from the remaining part of the symbol sequence.

3. The communication network according to claim 2, wherein said representation of prediction coefficients is based on reflection coefficients.

4. The communication network according to claim 1, wherein said representation of prediction coefficients is based on reflection coefficients.

5. The communication network according to claim 4, wherein said representation of prediction coefficients comprises logarithmic area ratios.

6. A receiver for receiving a speech signal represented by a symbol sequence including a representation of a plurality of prediction coefficients and a representation of an excitation signal, said receiver comprising a speech decoder which is arranged for reconstructing a speech signal from a partial symbol sequence in which the representation of some of the plurality of reflection coefficients is missing.

7. The receiver according to claim 6, wherein the speech decoder comprises a synthesis filter, and the speech decoder is arranged for deriving a reduced set of filter coefficients for the synthesis filter from said partial symbol sequence.

8. The receiver according to claim 7, wherein the speech decoder comprises a synthesis filter, and the speech decoder is arranged for deriving a reduced set of filter coefficients for the synthesis filter from said partial symbol sequence.

9. The receiver according to claim 6, wherein said representation of prediction coefficients is based on reflection coefficients.

10. A receiver for receiving a speech signal represented by a symbol sequence including a representation of a plurality of prediction coefficients and a representation of an excitation signal, which receiver comprises means for extracting a reduced number of prediction coefficients from said input signal, and is arranged for reconstructing a speech signal using said reduced number of prediction coefficients.

11. A speech decoder for decoding a speech signal represented by a symbol sequence including a representation of a plurality of prediction coefficients and a representation of an excitation signal, which decoder is arranged for reconstructing a speech signal from a partial symbol sequence in which the representation of some of the plurality of reflection coefficients is missing.

12. A speech decoder for reconstructing a speech signal represented by a symbol sequence including a representation of a plurality of prediction coefficients and a representation of an excitation signal, which speech decoder comprises means for extracting a reduced number of prediction coefficients from said input signal, and is arranged for reconstructing a speech signal using said reduced number of prediction coefficients.

13. A node for use in a communication network, arranged for receiving a symbol sequence representing a speech signal, the received symbol sequence comprising a representation of a plurality of prediction coefficients and a representation of an excitation signal, the node being arranged for transmitting a further symbol sequence derived from the received symbol sequence to a receiver, wherein the node comprises means for obtaining the further sequence by deleting a part of the received symbol sequence representing some of the prediction parameters.

14. A communication method comprising:

receiving a symbol sequence representing a speech signal, said symbol sequence comprising a representation of a plurality of prediction coefficients and a representation of an excitation signal;

obtaining a further symbol sequence by deleting a part of the received symbol sequence representing some of the prediction parameters; and transmitting the further symbol sequence.

* * * * *